US007204187B2

(12) United States Patent
Zeimetz et al.

(10) Patent No.: US 7,204,187 B2
(45) Date of Patent: Apr. 17, 2007

(54) DEVICE FOR TENSIONING AND SEALING TIGHTENING STRAPS

(75) Inventors: Leo Zeimetz, Buttelborn (DE); Detlef Scholl, Piesport (DE); Peter Nober, Rommersheim (DE)

(73) Assignee: Cyklop GmbH, Cologne (DE)

( * ) Notice: Subject to any disclaimer, the term of this patent is extended or adjusted under 35 U.S.C. 154(b) by 313 days.

(21) Appl. No.: 10/489,437

(22) PCT Filed: Sep. 12, 2002

(86) PCT No.: PCT/EP02/10220

§ 371 (c)(1),
(2), (4) Date: Aug. 16, 2004

(87) PCT Pub. No.: WO03/026967

PCT Pub. Date: Apr. 3, 2003

(65) Prior Publication Data

US 2005/0000586 A1 Jan. 6, 2005

(30) Foreign Application Priority Data

Sep. 20, 2001 (DE) ..... 101 46 460

(51) Int. Cl.
*B65B 13/22* (2006.01)
*B65B 13/30* (2006.01)

(52) U.S. Cl. ..... 100/29; 100/32; 100/33 PB; 156/495; 242/615.1

(58) Field of Classification Search ..... 100/8, 100/29, 30, 32, 33 PB, 34; 156/73.5, 229, 156/494, 495, 580; 226/15, 19, 20; 242/615.1, 242/615.3; 53/582, 590, 592; 254/216, 254/225

See application file for complete search history.

(56) References Cited

U.S. PATENT DOCUMENTS

| | | | | |
|---|---|---|---|---|
| 3,944,460 | A * | 3/1976 | Karr | 156/494 |
| 5,632,851 | A * | 5/1997 | Young | 156/494 |
| 6,003,578 | A * | 12/1999 | Chang | 156/494 |
| 6,079,456 | A * | 6/2000 | Drabarek et al. | 140/93.2 |
| 6,578,337 | B2 * | 6/2003 | Scholl et al. | 53/592 |
| 6,957,678 | B2 * | 10/2005 | Scholl et al. | 156/494 |

FOREIGN PATENT DOCUMENTS

| | | |
|---|---|---|
| DE | 4427135 A1 | 2/1996 |
| EP | 0620150 A1 | 10/1994 |
| EP | 0870679 A | 10/1998 |

* cited by examiner

*Primary Examiner*—Lowell A. Larson
*Assistant Examiner*—Jimmy Nguyen
(74) *Attorney, Agent, or Firm*—Fay Sharpe LLP

(57) ABSTRACT

Disclosed is a device for tensioning and sealing tightening straps of plastics for package tightenings, in which the superposed strap ends are received in a strap channel which is essentially open at a longitudinal outer side and the two faces. The strap channel has a strap edge guide at its longitudinal inner side for the inner edges of the tightening strap. A tensioning device is arranged in the front region of the device, and a sealing device is arranged in the rear region. So as to compensate for the forces acting outwardly on the upper strap end due to the irregular deformations of the upper strap end during the tensioning process by the tensioning roller of the tensioning device which is mounted in a floating manner, the strap edge guide is arranged obliquely to the tensioning direction of the tensioning roller and projects further into the strap channel in the vicinity of the strap sealing device than in the region of the tensioning device.

12 Claims, 2 Drawing Sheets

DEVICE FOR TENSIONING AND SEALING TIGHTENING STRAPS

FIELD OF THE INVENTION

The invention relates to a device for tensioning and sealing tightening straps, in particular straps of plastics, for package strappings. The device includes a strap channel for receiving overlapping or superposed strap ends of the tightening strap. The strap channel is essentially open at a longitudinal outer side and the front and rear faces. The strap channel comprises a strap edge guide for the inner edges of the tightening strap at its longitudinal inner side, a tensioning roller arranged in the front region of the device which partially grips into the strap channel during tensioning, acting on one of the two strap ends, and a strap sealing device arranged behind it in the tensioning direction.

BACKGROUND OF THE INVENTION

Devices of this type are used to provide packages, as for example large boxes or loaded pallets, with strappings and in this way hold together the goods stacked on the pallet or the boxes and to secure them for transport. For the production of the strapping, a rigid strap, usually formed from plastics, is laid around the package, the strap ends of which are tensioned against one another with the help of the device and are subsequently connected to one another. With plastic straps, the connection generally takes place with the help of a friction welding unit forming the sealing device.

So as to be able to tension the two strap ends, which are received in the strap channel of the device for the desired tensioning and sealing with the desired tension force against each other, it is necessary to press the tensioning roller during the tensioning process against one of the straps, in general the upper strap end, with a comparatively large force. The tensioning roller is mounted in an overhung position in most of the known devices, so as to enable a simple insertion of the strap ends into the strap channel from its longitudinal outer side and a simple removal of the device from the finished tightening. Due to the floating or overhung mounting of the tensioning roller and the high pressure forces during the tensioning process, the axis or shaft of the tensioning wheel is often deflected thereby causing the tensioning roller to elevate or tilt up at the longitudinal outer side of the strap channel. This in turn causes the pressing pressure exerted by the tensioning roller to the upper strap end, to not be uniform across the width of the strap. Instead, the pressure in the region of the inner strap edge is larger than at the outer edge. The larger pressing force at the inner edge of the tensioned strap end causes a greater (plastic) deformation of the strap (particularly if made of plastic) than in the region of the outer strap edge. That is, the tensioned (upper) strap end becomes thinner in the region of the inner strap edge and at the same time that region becomes longer than at the outer edge, whereby it is deflected in the direction toward the longitudinal outer side of the strap channel and does not lie in an edge exact manner on the other (lower) strap end. The strap ends are then also not connected to one another across their entire width whereby the rigidity of the strap joint or point of strap affixment or tightening suffers.

So as to eliminate this problem, it has been suggested to provide an outer strap edge guide at the longitudinal outer side of the strap channel in the region of the rear face of the strap channel, that is, in the vicinity of the strap sealing device, which guides the upper strap end during the tensioning process at its outer edge and thereby forces it into the strap channel, in which it lies, to the greatest possible extent, in an edge exact edge manner over the lower strap edge. But the additional outer edge guide has a considerable disadvantage in that it significantly hinders the threading of the strap ends into the strap channel and in particular the removal of the device from the finished tightening, as the strap ends or the tightening have to be brought past the outer edge guide. For this, it is generally necessary to provide a complex and a disruption-prone withdrawal mechanism for the outer edge guide, which releases the strap channel for threading the strap ends or removal of the device from the finished tightening at its longitudinal outer side. Alternatively, it has also already been suggested to arrange, against the action of a compression spring, a ball which can be countersunk in a recess in the region of the sealing device as the outer edge guide. This does not need a complicated withdrawal mechanism, but on the other hand, it has not proved to be particularly effective as a guide for the outer strap edge. It is also disadvantageous with the known devices with an additional outer strap edge guide that straps with different widths can only be processed with one device if the width of the strap channel between the inner and the outer strap edge guide is changed with an often considerable effort.

SUMMARY OF THE INVENTION

In a first aspect, the present invention provides a device for tensioning and closing tightening straps. The device includes a strap channel for receiving the superposed strap ends of the tightening strap. The strap channel is essentially open along a longitudinal outer side and front and rear faces. The strap channel comprises a strap edge guide for the inner edges of the tightening strap along its longitudinal inner side. The device also includes a tensioning roller arranged in the front region of the device which partially grips into the strap channel during tensioning thereby acting on one of the two strap ends. The device also includes a strap sealing device arranged behind the tensioning wheel. The strap sealing device is behind the tensioning wheel with respect to the tensioning direction. The strap edge guide runs obliquely to the tensioning direction of the tensioning roller and in the direction of the longitudinal outer side of the strap channel.

In another aspect, the present invention provides an assembly for tensioning and securing together two regions of a strap about an object. The assembly comprises a tensioning roller that is rotatable about a tensioning wheel axis. The roller is adapted to tension a strap placed in contact with the roller in a tensioning direction. The tensioning direction is generally transverse to the tensioning wheel axis. The assembly also comprises a strap edge guide positioned relative to the tensioning roller such that during tensioning of the strap contacting the roller, the strap edge guide also contacts the strap and causes the strap to extend along a corrected strap axis. During securing of the two strap regions, the regions are superposed and aligned over one another.

In yet another aspect, the present invention provides an assembly for tightening and welding together two overlapping regions of a strap about an object. The assembly comprises a support adapted for receiving the strap. The assembly also comprises a front edge stop movably positioned on the support. The front edge stop defines a first face for contacting the strap. The assembly also comprises a rear edge stop movably positioned on the support. The rear edge stop defines a second face for contacting the strap. The assembly further comprises a tensioning roller that is rotatable about a tensioning wheel axis. The tensioning roller is adapted to tighten the strap contacting the roller in a tensioning direction. The tensioning direction is generally transverse to the tensioning wheel axis. The front edge stop and the rear edge stop are positioned on the support relative to the tensioning roller such that during tightening and welding together of the two overlapping regions of the strap, the first and second faces of the front and rear edge stops contact the strap and cause the strap to extend along a corrected strap axis.

BRIEF DESCRIPTION OF THE DRAWINGS

Further characteristics and advantages of the invention result from the following description and the drawings, in which a preferred embodiment of the invention is explained in further detail with an example. It shows.

BRIEF DESCRIPTION OF THE PREFERRED EMBODIMENTS

Figure 1:
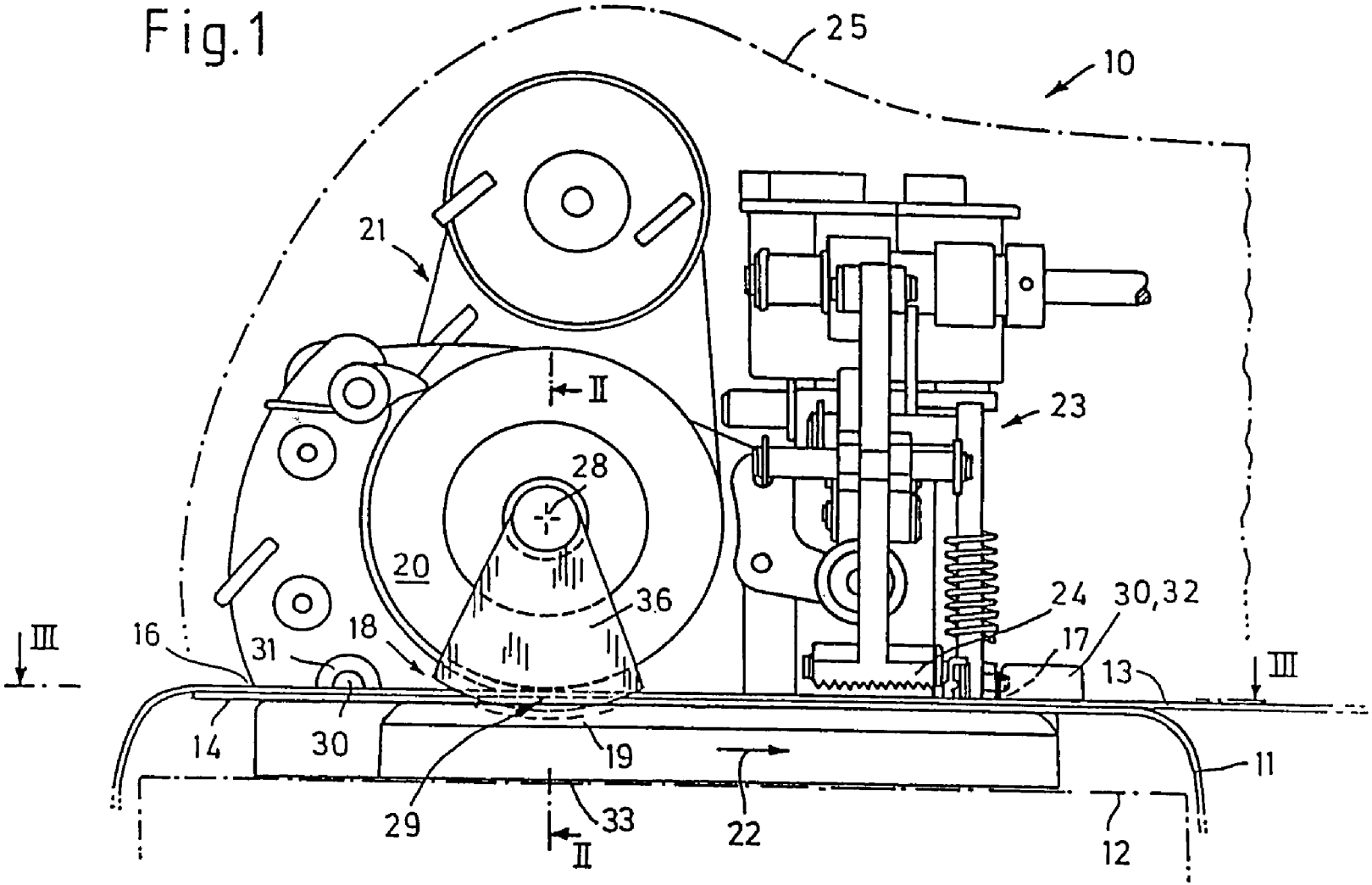
FIG. 1 schematically illustrates a device according to the invention for tensioning and sealing of tightening straps in the region of their tensioning and sealing device in a broken out side view.

It is an object of the invention to avoid the previously noted disadvantages and to provide a device of the above-mentioned type in such a manner that the strap ends which are tensioned against one another are also superposed largely without offset even without a strap edge guide at the longitudinal outer side of the strap channel in the region of the sealing device.

This object is solved by means of the invention in that the strap edge guide at the longitudinal inner side of the strap channel runs obliquely to the tensioning direction of the tensioning roller in the direction toward the longitudinal outer side of the strap channel.

According to the invention, the inner strap edge guide does not run parallel to the tensioning direction of the tensioning roller and thereby does not extend at a right angle to the axis of that roller, but is positioned slightly obliquely to the tensioning direction, whereby the guide runs essentially parallel to the position of the (upper) strap end charged by the tensioning roller during the tensioning process. As the second (lower) strap end also abuts the strap guide arranged obliquely to the tensioning roller, it is in the region of the sealing device in the same flight as the first tensioned strap end and is thereby connected thereto along its entire width. The superposed straps are thereby aligned obliquely to the tensioning direction in such a manner that a force component is produced which acts on the longitudinal inner side of the strap channel on the (upper) strap to be tensioned during the transport and tensioning process which compensates the run of the free strap to the strap channel outer side due to the strap deformation caused by the tensioning roller. An additional outer strap edge guide in the region of the strap sealing device can thereby be entirely eliminated.

The strap edge guide preferably comprises a front edge stop arranged near the tensioning roller and a rear edge stop in the vicinity of the strap sealing device, whereby the rear edge stop projects further in the direction toward the longitudinal outer side into the strap channel than the front edge stop. With this constructively particularly simple alternative, the strap ends only receive a guide of their inner edges where their position is particularly important, that is, in the region of the sealing device and at the tensioning roller.

The strap edge guide is conveniently aligned obliquely to the tensioning direction of the tensioning roller at an angle of about 1° to about 6°, which corresponds to the angle by which the free strap end—depending on the type of the strap material used and the size of the pressure force of the tensioning roller—is deflected relative to the tangential or tensioning direction of the tensioning roller in the direction of the longitudinal inner side of the strap channel limited by the strap edge guide.

The strap edge guide can be adjustable in its angular position relative to the tensioning direction, whereby it is possible to adapt the device to the degree of the strap end deflection which is to be compensated.

It is also possible to develop the strap edge guide in an adjustable manner transversely to the tensioning direction, so as to accommodate the different widths of the tightening straps coming into use, if this is desired in the individual case. Preferably, the front and/or rear edge stop can be adjusted transversely to the tensioning direction of the tensioning roller, whereby, on the one hand, the angular position of the strap edge guide, on the other hand, the effective width of the strap channel can be varied.

So as to ease the handling of the device, it is advantageous if the strap channel can be sealed in its front region in the vicinity of the tensioning roller with an outer strap stop, which can be countersunk together with the tensioning roller and thus prevent an inadvertent exit of the strap laterally from the strap channel during the transport and tensioning process.

The device designated as 10 as a whole in FIG. 1 serves for producing a strapping 11 for a package 12 by means of a tightening strap of plastic, which is laid around the package and tensions its two strap ends 13, 14 against each other by means of the device and which are subsequently welded together.

Figure 2:
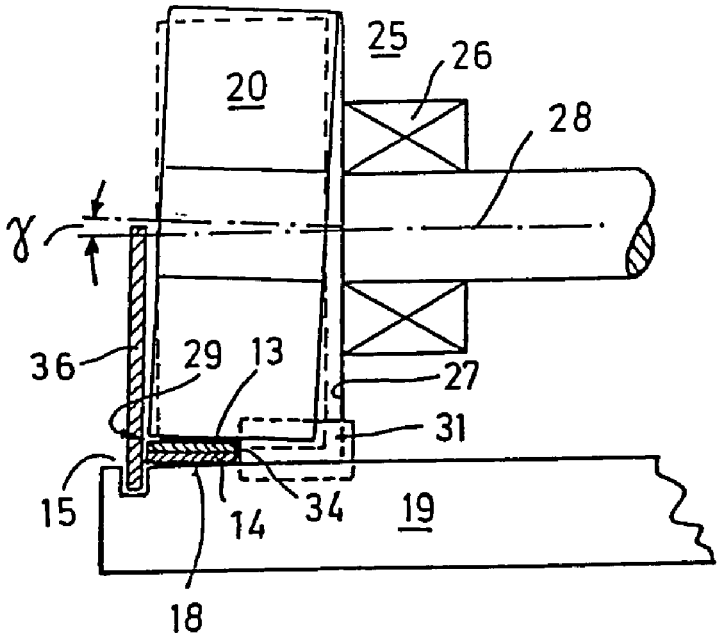
FIG. 2 is a partial cross section through the device according to FIG. 1 in the region of its tensioning direction along line II—II.
Figure 3:
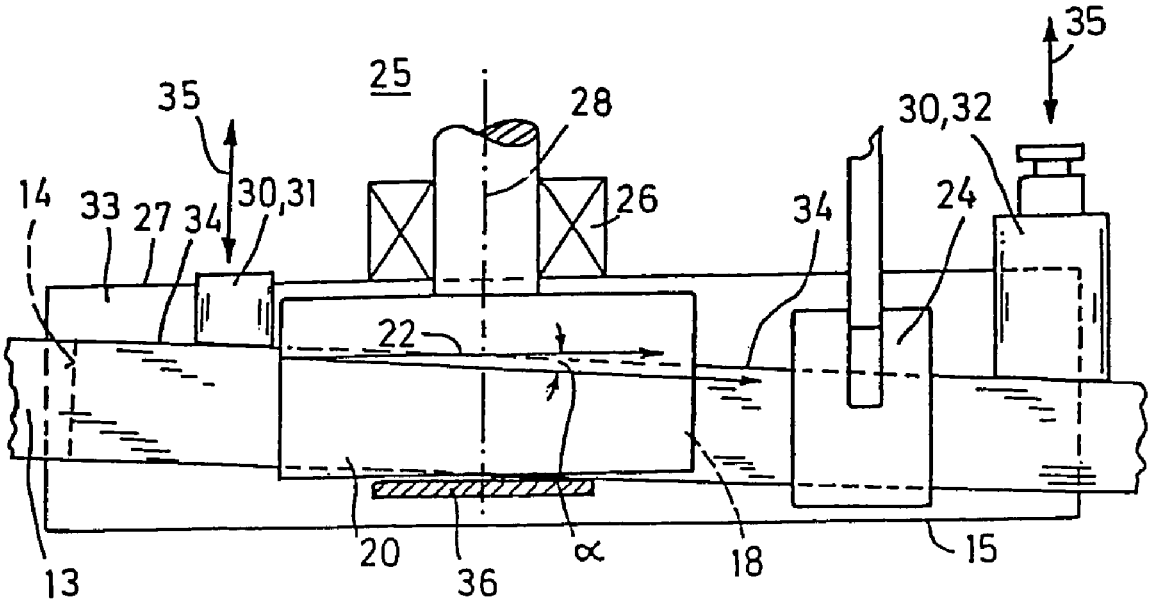
FIG. 3 is a section through the device according to FIG. 1 along line III—III.

Referring to FIGS. 1–3, the device 10 comprises a strap channel 18 extending in its longitudinal direction, open at a longitudinal outer side 15 and the front and rear faces 16, 17, which is limited by a pressure plate 19 below and into which a tensioning roller 20 of a tensioning device 21 can be inserted together with a leading outer strap stop 36. The strap ends from the longitudinal outer side 15 of the channel are inserted into the strap channel for the production of the tightening. The tensioning roller 10 and the outer strap stop 36 are pivoted downwards after the insertion of the strap ends 13, 14 into the strap channel 18, whereby the outer strap stop 36 prevents that the strap leaves the channel again. The tensioning roller presses firmly onto the upper strap end 13 during the tensioning process and draws it in the tensioning direction 22 over the lower strap end 14, until the desired strap tension is reached. A sealing device with friction welding unit 24 arranged in the tensioning direction 22 behind the tensioning roller moves the upper strap end with a high velocity to and fro over the lower strap end, so that the two strap ends weld together due to the generated frictional heat. The functionality of such implements is known, so that a detailed description is not necessary.

As can be seen from FIGS. 2 and 3, the tensioning roller 20 is mounted in the housing 25 of the device in a floating manner with an antifriction bearing and projects from the longitudinal inner side 27 which limits the strap channel 18 inside into this. So as to be able to tension the upper strap end 13 with the desired high tension force, it is necessary to press the tensioning roller 20 with a large force onto the tightening strap with the help of a stop mechanism, not shown in detail. This results in that the freely projecting part of the tensioning wheel axis 28 bends upwards, that is, the axis does not run parallel to the pressure plate 19 during the tensioning process. Instead, the gap 29 formed from the pressure plate 19 on the one hand and from the tensioning wheel 20 on the other hand becomes wedge- or trapezoidal-shaped and is narrower in the region of the longitudinal inner side 27 of the strap channel than at its longitudinal outer side 15. This circumstance is shown slightly exaggerated in FIG. 2 for illustration. It can be seen that the tension roller axis 28 is deflected upwards by an angle $\gamma$ with regard to the shown desired dotted position of the tensioning wheel due to the high pressure force.

The described circumstance results in that the upper strap end 13 is compressed more in the region facing the longitudinal inner side 27 of the strap channel than near its outer edge. This again leads thereto that the upper strap end 13 is deflected due to the irregular plastic deformation across its width in the direction of the longitudinal outer side of the strap channel, while the lower strap end 14 does not experience such a deformation and deflection or in any case in only a much smaller measure. With the devices known up to now, one had to take into account the lateral run of the upper strap end by special measures, for example by an additional outer edge guide which closes the strap channel in the region of its sealing device at its longitudinal outer side even during the tensioning process, which forced the upper strap end back into the strap channel, so that the two strap ends were superposed as exactly as possible in the region of the sealing device, so as to be able to be welded together across their entire width.

In contrast to this, the device according to the invention manages in the rear region of the strap channel in the tensioning direction only with a strap edge guide 30 arranged at the longitudinal inner side 27 to compensate for the negative effect of the irregular compression of the upper strap end during the tensioning. Preferably, the strap edge guide 30, which consists in the example of the embodiment essentially of a front edge stop 31 arranged near the tensioning roller 20 and a rear edge stop 32 in the vicinity of the friction welding unit, is arranged obliquely to the tensioning direction 22 of the tensioning roller 20 with an angle $\alpha$ of about 3°. That is, the rear edge stop projects further in the direction towards the longitudinal outer side 15 into the strap channel 18 than the front edge stop. Preferably, each of the front edge stop 31 and the rear edge stop 32 defines a face for contacting the inner edge 34 of the strap undergoing tensioning. The strap edge guide 30 formed by the two edge stops ensures that the two strap ends 13, 14 in the strap channel 18 do not lie approximately parallel to the tensioning direction 22 of the tensioning roller, but run obliquely to the tension direction with the angle $\alpha$, which at least approximately corresponds to the angle by which the upper strap end 13 is deflected during the tensioning process due to the irregular pressure forces across the strap width. The axis along which the inner strap edge 34 extends as a result of the position of the strap edge guide 30 (preferably in the form of the front and rear edge stops 31 and 32) is referred to herein as the "corrected strap axis." The two strap ends lie thereby in the intake region 33 in the tensioning direction 22 in front of the tensioning roller 20 to the greatest possible extent on top of one another with regard to their edges, as can be seen in FIG. 3, and are aligned in the region of the sealing device 23. They are therefore welded to one another by means of the friction welding unit in an edge exact manner, so that the weld seam receives a rigidity which is as high as possible.

It can be seen that it is possible, by the tangential deviation of the axis of the tensioning wheel relative to the inner strap edge guide 30, at which the inner edges 34 of the strap ends are guided, to do without additional guide organs which guide the upper strap end 13 which is deformed in an irregular manner by the tensioning roller 20 and thereby deflected outwardly at its outer edge and to force it back into the strap channel, so as to lie in an edge exact manner on the essentially non-deformed lower strap end and to enable a weld seam across the entire strap width. By the elimination of outer, technically complex strap edge guides it is possible, with the device according to the invention, to process tightening straps with different widths without complex modification measures, as the straps only have to be guided at their one inner edge 34.

As can be seen in FIG. 3, the rear edge stop 32 is arranged transversely adjustable to the tensioning direction 22 in the housing 25, which is indicated by the double arrow 35. Through this it is possible to change the angle $\alpha$, by which the strap edge guide 30 is positioned obliquely relative to the tensioning direction 22. Therewith, the circumstance can be accommodated that the amount of the compression of the upper strap end and thereby its deflection from strap material to strap material and changes in dependence on the exerted pressure forces. The angular adjustment of the strap edge guide possible in this way can take place in a simple manner by means of an adjustment screw (not shown) accessible from the outer side of the housing. It is even feasible to realize an automatic adjustment of the rear edge stop, which adjusts, in dependence of a deflection of the axis 28 of the tensioning roller by means of measurement value recorders and a given plastic strap material, the correct position of the rear edge stop with an actuator.

The invention is not limited to the shown and described example of the preferred embodiment, but various changes and additions are feasible without departing from the scope of the invention. It is possible to develop the front edge stop transversely adjustable to the tensioning direction. The strap edge guide can for example also consist of a continuous guide rail which essentially extends from the front to the rear end of the pressure plate.

We claim:

1. A device for tensioning and closing tightening straps having superposed two strap ends, in particular straps of plastics, for package strappings, the device having a front region and comprising a strap channel, a tensioning roller, and a strap sealing device, the strap channel having front and rear faces and longitudinal inner and outer sides extending therebetween, the strap channel receiving the superposed strap ends of the tightening strap, which strap channel is essentially open at the longitudinal outer side and the front and rear faces and which strap channel comprises a strap edge guide for the inner edges of the tightening strap at its longitudinal inner side, the tensioning roller arranged in the front region of the device which partially grips into the strap channel during tensioning thereby acting on one of the two strap ends and with the strap sealing device arranged behind the tensioning roller in a tensioning direction, wherein the strap edge guide runs obliquely to the tensioning direction of the tensioning roller in the direction of the longitudinal outer side of the strap channel.

2. The device according to claim 1, wherein the strap edge guide includes a front edge stop arranged near the tensioning roller and a rear edge stop in the vicinity of the strap sealing device, wherein the rear edge stop projects further in the direction towards the longitudinal outer side into the strap channel than the front edge stop.

3. The device according to claim 1 wherein the strap edge guide is arranged obliquely to the tensioning device of the tensioning roller with an angle (α) of 1° to 6°.

4. The device according to claim 1 wherein the strap edge guide can be adjusted in its angular position relative to the tensioning direction.

5. The device according to claim 1 wherein the strap edge guide can be adjusted transversely to the tensioning direction.

6. The device according to claim 1 wherein the front and/or rear edge stop can be adjusted transversely to the tensioning direction of the tensioning roller.

7. The device according to claim 1 wherein the strap channel can be sealed with an outer strap stop at its front region in the vicinity of the tensioning roller.

8. An assembly for securing together two regions of a strap about an object, the assembly comprising:

a tensioning roller rotatable about a tensioning wheel axis, the roller adapted to tension a strap placed in contact with the roller in a tensioning direction, the tensioning direction being generally transverse to the tensioning wheel axis; and a strap edge guide positioned relative to the tensioning roller such that during tensioning of the strap contacting the roller, the strap edge guide also contacts the strap and causes the strap to extend along a corrected strap axis, whereby during securing of the two strap regions, the regions are superposed and aligned over one another, wherein the corrected strap axis extends at an angle of from about 1° to about 6° with respect to the tensioning direction.

9. The assembly of claim 8 wherein the angle is 3°.

10. An assembly for tightening and welding together two overlapping regions of a strap about an object, the assembly comprising:

a support adapted for receiving the strap;

a front edge stop movably positioned on the support, the front edge stop defining a first face for contacting the strap;

a rear edge stop movably positioned on the support, the rear edge stop defining a second face for contacting the strap; and a tensioning roller that is rotatable about a tensioning wheel axis, the tensioning roller adapted to tighten the strap contacting the roller in a tensioning direction, the tensioning direction being generally transverse to the tensioning wheel axis;

wherein the front edge stop and the rear edge stop are positioned on the support relative to the tensioning roller such that during tightening and welding together of the two overlapping regions of the strap, the first and second faces of the front and rear edge stops contact the strap and cause the strap to extend along a corrected strap axis, wherein the corrected strap axis extends at an angle of from about 1° to about 6° with respect to the tensioning direction.

11. The assembly of claim 10 wherein the angle is 3°.

12. An assembly for tightening and welding together two overlapping regions of a strap about an object, the assembly comprising:

a support adapted for receiving the strap;

a front edge stop movably positioned on the support, the front edge stop defining a first face for contacting the strap;

a rear edge stop movably positioned on the support, the rear edge stop defining a second face for contacting the strap; and a tensioning roller that is rotatable about a tensioning wheel axis, the tensioning roller adapted to tighten the strap contacting the roller in a tensioning direction, the tensioning direction being generally transverse to the tensioning wheel axis;

wherein the front edge stop and the rear edge stop are positioned on the support relative to the tensioning roller such that during tightening and welding together of the two overlapping regions of the strap, the first and second faces of the front and rear edge stops contact the strap and cause the strap to extend along a corrected strap axis, wherein the tensioning roller is disposed between the front edge stop and the rear edge stop.

* * * * *